US012623881B2

(12) United States Patent
Benes

(10) Patent No.: US 12,623,881 B2
(45) Date of Patent: May 12, 2026

(54) TAPE APPLICATOR APPARATUS

(71) Applicant: David J. Benes, Blair, NE (US)

(72) Inventor: David J. Benes, Blair, NE (US)

( * ) Notice: Subject to any disclaimer, the term of this patent is extended or adjusted under 35 U.S.C. 154(b) by 282 days.

(21) Appl. No.: 18/403,460

(22) Filed: Jan. 3, 2024

(65) Prior Publication Data

US 2024/0132320 A1 Apr. 25, 2024

Related U.S. Application Data

(63) Continuation-in-part of application No. 17/939,319, filed on Sep. 7, 2022, now abandoned.

(60) Provisional application No. 63/320,843, filed on Mar. 17, 2022.

(51) Int. Cl.
*B65H 35/00* (2006.01)

(52) U.S. Cl.
CPC ..... *B65H 35/0033* (2013.01); *B65H 35/008* (2013.01)

(58) Field of Classification Search
CPC .... B65H 35/00; B65H 35/008; B65H 35/006; B65H 35/0033; B65H 35/0013; B65H 2301/51539; B65H 2801/81; B26F 3/12; B65B 51/06
USPC ..... 83/171
See application file for complete search history.

(56) References Cited

U.S. PATENT DOCUMENTS

| | | | | |
|---|---|---|---|---|
| 2,987,598 | A | 6/1961 | Chace et al. | |
| 3,299,756 | A | 1/1967 | Harry | |
| 4,319,952 | A | 3/1982 | Schjeldahl | |
| 4,672,872 | A * | 6/1987 | Kuehnert | B26F 3/12 83/16 |
| 8,029,428 | B2 | 10/2011 | Selle et al. | |

FOREIGN PATENT DOCUMENTS

DE 102018132750 A1 * 6/2020 ..... B65H 35/0013

OTHER PUBLICATIONS

Translation DE102018132750 A1 (Year: 2026).*

* cited by examiner

*Primary Examiner* — Nhat Chieu Q Do
(74) *Attorney, Agent, or Firm* — Suiter Swantz IP

(57) ABSTRACT

A tape applicator apparatus is disclosed and includes a tape cutter mechanism and a (tape) puller mechanism. The tape cutter mechanism includes a first frame, a product tension mechanism coupled to the first frame, and a hot wire assembly coupled to the first frame. The hot wire assembly includes a first mount, a second mount, and a wire between the first mount and the second mount. The puller mechanism includes a puller frame, a grabber coupled to the puller frame, and a grab actuator coupled to the grabber. The grab actuator may activate a grab operation of the grabber. The puller mechanism includes a reach actuator coupled to the puller frame and the grabber. The tape applicator apparatus may be configured to receive a package between the tape cutter mechanism and the puller mechanism.

19 Claims, 10 Drawing Sheets

TAPE APPLICATOR APPARATUS

CROSS-REFERENCE TO RELATED APPLICATION

The present application claims the benefit under 35 U.S.C. § 120 of U.S. patent application Ser. No. 17/939,319, filed on Sep. 7, 2022 entitled HOT WIRE CUTTER APPARATUS, naming David J. Benes, which claims the benefit under 35 U.S.C. § 119(e) of U.S. Provisional Application Ser. No. 63/320,843, filed Mar. 17, 2022, entitled TAPE APPLICATOR APPARATUS, naming David Benes as inventor, all applications of which are incorporated herein by reference in their entirety.

FIELD

The present disclosure is directed to industrial tools, and more specifically to a tape applicator apparatus.

BACKGROUND

In the manufacture of items and packaging of those items, it is common to apply one or more pieces of tape to secure a package. In a mass-production facility, the application of the tape may be automated. Conventional techniques and systems to apply a piece of tape are limited due to their complex nature, cost, and potential safety concerns which are exacerbated if the product is a food item. For example, conventional cutting devices may have breakage, whereby elements of a cutter may be inadvertently placed within a product, such as a food item.

SUMMARY

A tape applicator apparatus is disclosed in accordance with one or more illustrative embodiments of the present disclosure. In one illustrative embodiment, the tape applicator apparatus may include a tape cutter mechanism. In another illustrative embodiment, the tape cutter mechanism may include a first frame, a product tension mechanism coupled to the first frame configured to support a tape roll including tape, and a device to position the tape in proximity with a hot wire assembly. In another illustrative embodiment, the hot wire assembly may be coupled to the first frame and may include a first mount, a second mount, and a wire between the first mount and the second mount. In another illustrative embodiment, a moving assembly may be configured to raise and lower the hot wire assembly. In another illustrative embodiment, the first frame may be configured to route the tape to a cutting position, where the wire is configured to perform a cut of the tape in the cutting position via the moving assembly. In another illustrative embodiment, the tape applicator apparatus may include a puller mechanism. In another illustrative embodiment, the puller mechanism may include a puller frame, a grabber coupled to the puller frame comprising a first grabber element and a second grabber element, a grab actuator coupled to the grabber configured to activate a grab operation of the grabber, and a reach actuator coupled to the puller frame and the grabber. In another illustrative embodiment, the grab operation may be configured to grab the tape between the first grabber element and the second grabber element. In another illustrative embodiment, the reach actuator may be configured to extend the grabber towards the tape in the cutting position of the tape cutter mechanism and retract the grabber and the tape. In another illustrative embodiment, a package may be configured to be received between the tape cutter mechanism and the puller mechanism such that the package lands on the tape and falls between the tape cutter mechanism and the puller mechanism.

In a further aspect, the tape applicator apparatus may further include an electrical power source coupled to the wire and configured to heat the wire. In another aspect, the electrical power source may supply a 2-9 volt voltage input to the wire. In another aspect, the voltage input to the wire may be pulsed. In another aspect, the moving assembly may comprise at least one of an air cylinder or a hydraulic cylinder. In another aspect, the device to position the tape in proximity with the hot wire assembly may comprise a vacuum block or an air block that supplies air toward the tape. In another aspect, the tape may be configured to be wiped onto the package as the package falls below the tape applicator apparatus via a first tape wiper of the tape cutter mechanism and via a second tape wiper of the puller mechanism. In another aspect, the first tape wiper may be coupled to the first frame and a first wiper actuator may be configured to rotate the first tape wiper towards the second tape wiper. In another aspect, the second tape wiper may be coupled to the puller frame and a second wiper actuator may be configured to rotate the second tape wiper towards the first tape wiper. In another aspect, the tape cutter mechanism may be located a package receiving distance from the puller mechanism, which may be 6 inches or more, 24 inches or more, or a range of sizes of 4 inches or more. In another aspect, the first tape wiper may be configured to rotate a non-zero wiper angle of the first tape wiper and the second tape wiper may be configured to rotate a non-zero wiper angle of the second tape wiper, where both non-zero wiper angles are measured inwards from vertical, normal from the tape, and may be 3 degrees or more, 10 degrees or more, or 20 degrees or more. In another aspect, the reach actuator may be configured for a reach distance of 12 inches or more or 24 inches or more.

This Summary is provided solely as an introduction to subject matter that is fully described in the Detailed Description and Drawings. The Summary should not be considered to describe essential features nor be used to determine the scope of the Claims. Moreover, it is to be understood that both the foregoing Summary and the following Detailed Description are example and explanatory only and are not necessarily restrictive of the subject matter claimed.

BRIEF DESCRIPTION OF THE DRAWINGS

The detailed description is described with reference to the accompanying figures. The use of the same reference numbers in different instances in the description and the figures may indicate similar or identical items. Various embodiments or examples ("examples") of the present disclosure are disclosed in the following detailed description and the accompanying drawings. The drawings are not necessarily to scale. In general, operations of disclosed processes may be performed in an arbitrary order, unless otherwise provided in the claims. In the drawings:

DETAILED DESCRIPTION

Figure 1A:
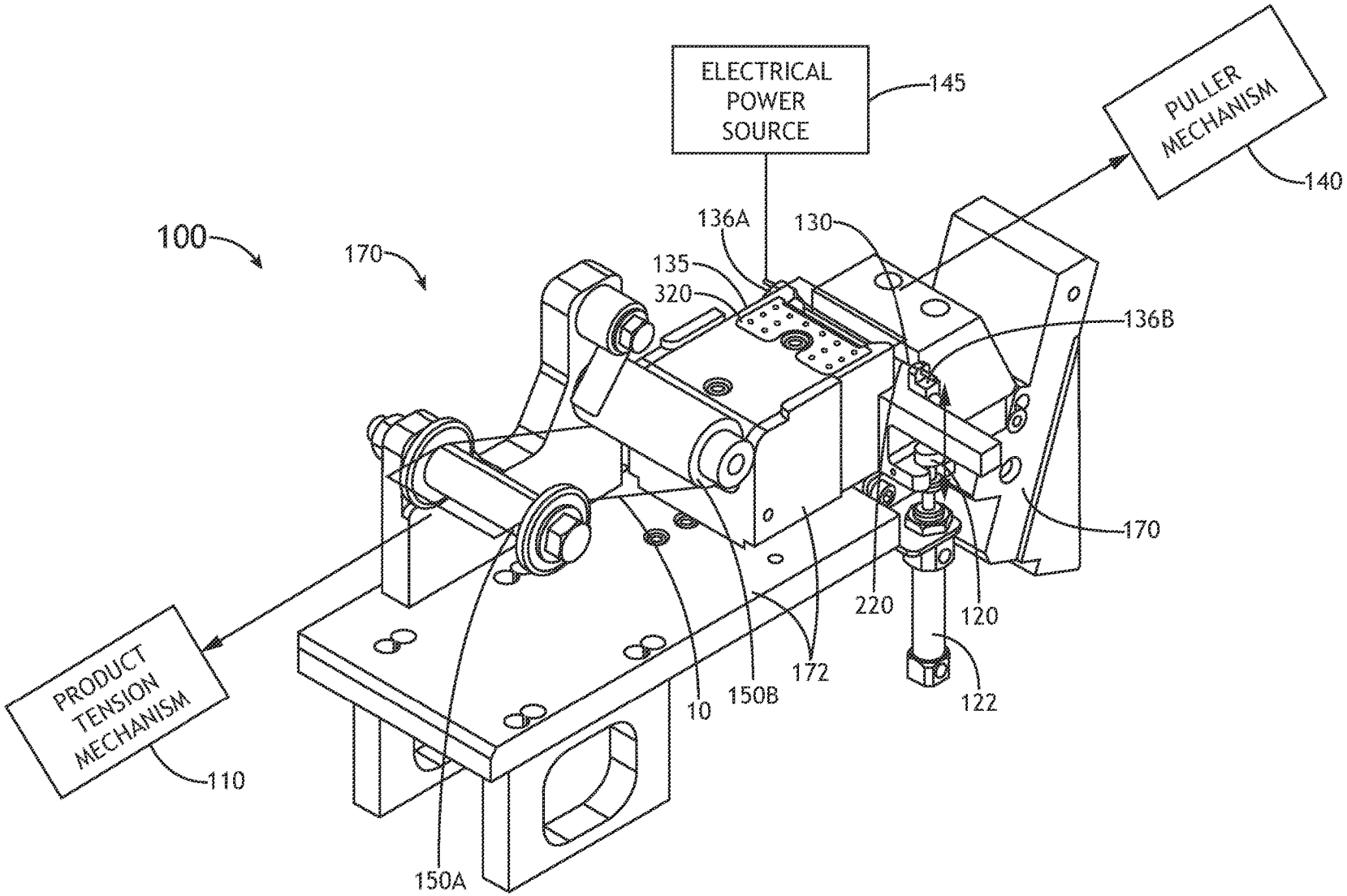
FIG. 1A is a diagram of a tape cutter mechanism of a tape applicator apparatus with a moving assembly and a wire in a lower position in accordance with an embodiment of this disclosure.

Before explaining one or more embodiments of the disclosure in detail, it is to be understood that the embodiments are not limited in their application to the details of construction and the arrangement of the components or steps or methodologies set forth in the following description or illustrated in the drawings. In the following detailed description of embodiments, numerous specific details may be set forth in order to provide a more thorough understanding of the disclosure. However, it will be apparent to one of ordinary skill in the art having the benefit of the instant disclosure that the embodiments disclosed herein may be practiced without some of these specific details. In other instances, well-known features may not be described in detail to avoid unnecessarily complicating the instant disclosure.

Broadly speaking, embodiments of the present disclosure are directed to a tape applicator apparatus configured to apply tape to packages. Embodiments may be configured to grab the tape, pull the tape out, cut the tape with a hot wire, and apply the tape to a package (e.g., wiping the tape onto the package as the package is lowered onto the tape).

The tape applicator apparatus may include a tape cutter mechanism (e.g., for storing and cutting the tape), and a puller mechanism (e.g., for grabbing, pulling the tape). Both the tape cutter mechanism and the puller mechanism may be configured to receive a package from above and apply the tape to the package. See FIG. 4 for an example of a package 20 being received by the tape applicator apparatus 100.

The tape applicator apparatus 100 provides a number of advantages and benefits over conventional cutting systems known to the art. For example, some conventional cutting systems for tape employ an ultrasonic knife. However, this requires regular blade maintenance. Additionally, use of the blades over time can reduce the strength of the blades, whereby the blades may break. This can be extremely dangerous, particularly when involved in an application for packaging a food item.

Advantageously, the tape applicator apparatus 100 of the present disclosure leaves a clean, consistent, and straight edge. The tape applicator apparatus 100 includes a wire that is heated by electricity and may raise up into the full width of the tape. By cutting the entire width of tape at once, the tape has an edge that can be gripped and pulled consistently.

Referring to FIG. 1A, a diagram illustrating a tape cutter mechanism 170 including a hot wire assembly 130 in a lower position (e.g., prepared to cut tape 10) in accordance with an embodiment of this disclosure is shown.

The tape cutter mechanism 170 may include a first frame 172, product tension mechanism 110 coupled to the first frame 172, and a hot wire assembly 130 coupled to the first frame 172.

The hot wire assembly 130 may include a first mount 136A, a second mount 1366, and a wire 220 between and coupled to the first mount 136A and the second mount 1366.

A moving assembly 120 may be configured to raise and lower the hot wire assembly 130. As shown in FIG. 1A, the moving assembly 120 is in a lower (or stored) position, such that the wire 220 is below the tape 10. Moving assembly 120 may include a support structure (e.g., the moving assembly actuator 122) which supports the hot wire assembly 130 and is coupled to the first frame 172. The moving assembly 120 may include the moving assembly actuator 122, such as at least one of an air cylinder 122, or a hydraulic cylinder 122, for performing the raising and the lowering. As such, the air cylinder, the hydraulic cylinder may be coupled to a controller (e.g., electronically controlled hydraulic actuator; computer with non-transitory memory) and the like. It is contemplated that the hot wire assembly 130 may be raised to the level of the tape 10 and cut the tape 10 in approximately 3-4 microseconds. Additionally, or alternatively, (not shown) the hot wire assembly 130 may be lowered to cut the tape 10 where the tape 10 is below the wire 220 prior to the cutting.

The first frame 172 may be configured to route the tape 10 (e.g., route through rollers 150A, 150B, and the like) to a cutting position (e.g., any position where the wire 220 may cut the tape 10, such as the position shown in FIG. 1A). Tape applicator apparatus 100 may include the one or more rollers 150A, 150B which may support and allow tape 10 to be routed/transported to ensure a desired length of tape 10 is provided prior to cutting.

Depending on the arrangement, it may be possible for roller 150A, 150B to be in contact with an adhesive side of the tape 10. In such a situation, roller 150A, 1506 may include an exterior surface that includes a material which may allow adhesive to remain in contact with the roller without adhering to the rollers 150A, 150B.

The tape applicator apparatus 100 may further include a device 135 (e.g., a device to move the tape 10 up or down into the wire 220 to aide in cutting) to position a tape 10 in proximity with the hot wire assembly 130 to be cut by the wire 220 of the hot wire assembly 130. It is contemplated that the device 135 to position a tape 10 in proximity with the hot wire assembly 130 may include a vacuum block 320 (e.g., surface 320 defining holes and configured to suck the tape 10 towards the surface) which may be configured to operate at a desired pressure range in order to secure and/or pull the tape 10 towards the hot wire assembly 130 (e.g., towards the surface 320) in a non-contact fashion. In another embodiment, the device 135 to position a tape 10 in proximity with the hot wire assembly 130 may include an air block 320 above or below the tape 10 which maintains or pushes the tape 10 toward the hot wire assembly 130. For example, the air block 320 may blow air through holes of a surface (e.g., surface 320), and may be above or below the tape 10, and therefore may blow the tape 10 up or down towards the wire 220, depending on the location. It is contemplated that the air block could be positioned over the tape 10 to provide a blast of air that pushes the tape 10 toward the wire 220 hot wire assembly 130. Other types of devices may be employed to push the tape 10 toward the hot wire assembly 130 such as an actuatable/moveable pad/surface (e.g., surface 320 may be moveable).

Tape applicator apparatus 100 may include a product tension mechanism 110 which may maintain tension of a portion of tape 10, such as a roll of tape, prior to cutting. See FIG. 3A for an example of a product tension mechanism 110 configured to store a tape roll 114 including tape.

The wire 220 of the hot wire assembly 130 may be formed of various types of metal and may be configured to handle ultra-high temperatures (e.g., more than 200 degrees Celsius). In an embodiment, the wire 220 may be a metal alloy, and may include nickel and chromium, and may further include iron. In one example, the wire 220 may be nichrome. It is contemplated that the wire 220 may be supplied a voltage input from an electrical power source 145. The electrical power source 145 may be coupled to the wire 220 and may be configured to heat the wire 220. The voltage input from the electrical power source 145 may provide a voltage input from 2-9 volts, preferably 3-8 volts, and most preferred 5-7 volts. When the voltage input is applied to the wire 220 of the hot wire assembly 130, the wire 220 of the hot wire assembly 130 may reach a temperature of 200 degrees Celsius. In an embodiment of the disclosure, the wire 220 of hot wire assembly 130 may be charged continuously, but may be pulsed to a charged state if desired in an alternative embodiment. It is contemplated that electrical power source 145 may be coupled to a first end or a second end of the wire 220 (e.g., either end), or the electrical power source 145 may be coupled to the first mount 136A and second mount 136B of the hot wire assembly 130 in order to provide the voltage input. Electrical power source 145 may be an AC power source or DC power source, and may further include a power supply which receives input power and converts the input power to a desired output supply.

Figure 1B:
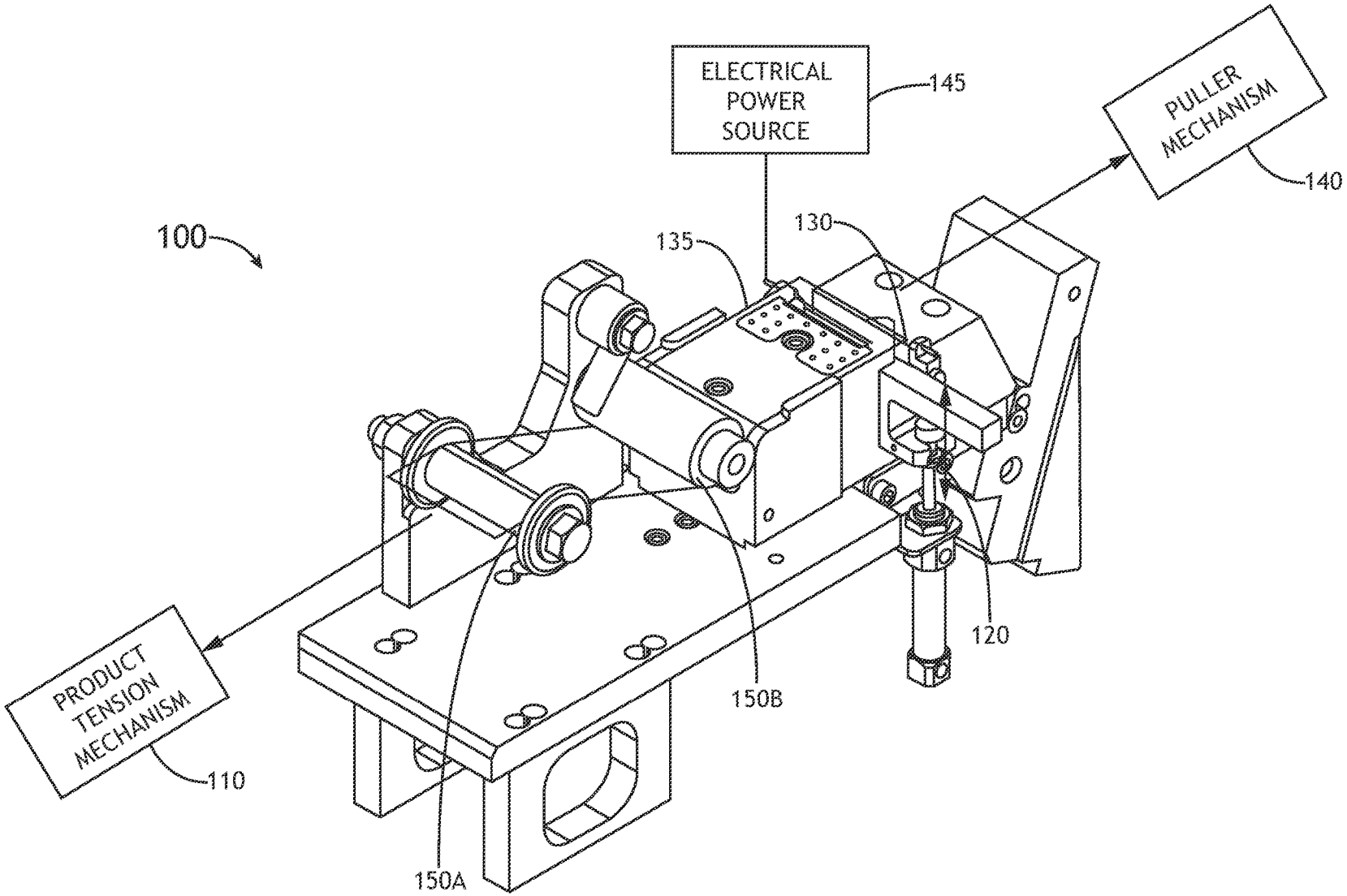
FIG. 1B is diagram of a tape cutter mechanism of a tape applicator apparatus with a moving assembly and the wire in an upper position in accordance with an embodiment of this disclosure.

Referring to FIG. 1B, a tape applicator apparatus 100 with the hot wire assembly 130 in an upper position is illustrated in accordance with an embodiment of this disclosure is shown. For example, the wire 220 may be raised to the upper position to cut the tape 10 using the moving assembly actuator 122.

Figure 2:
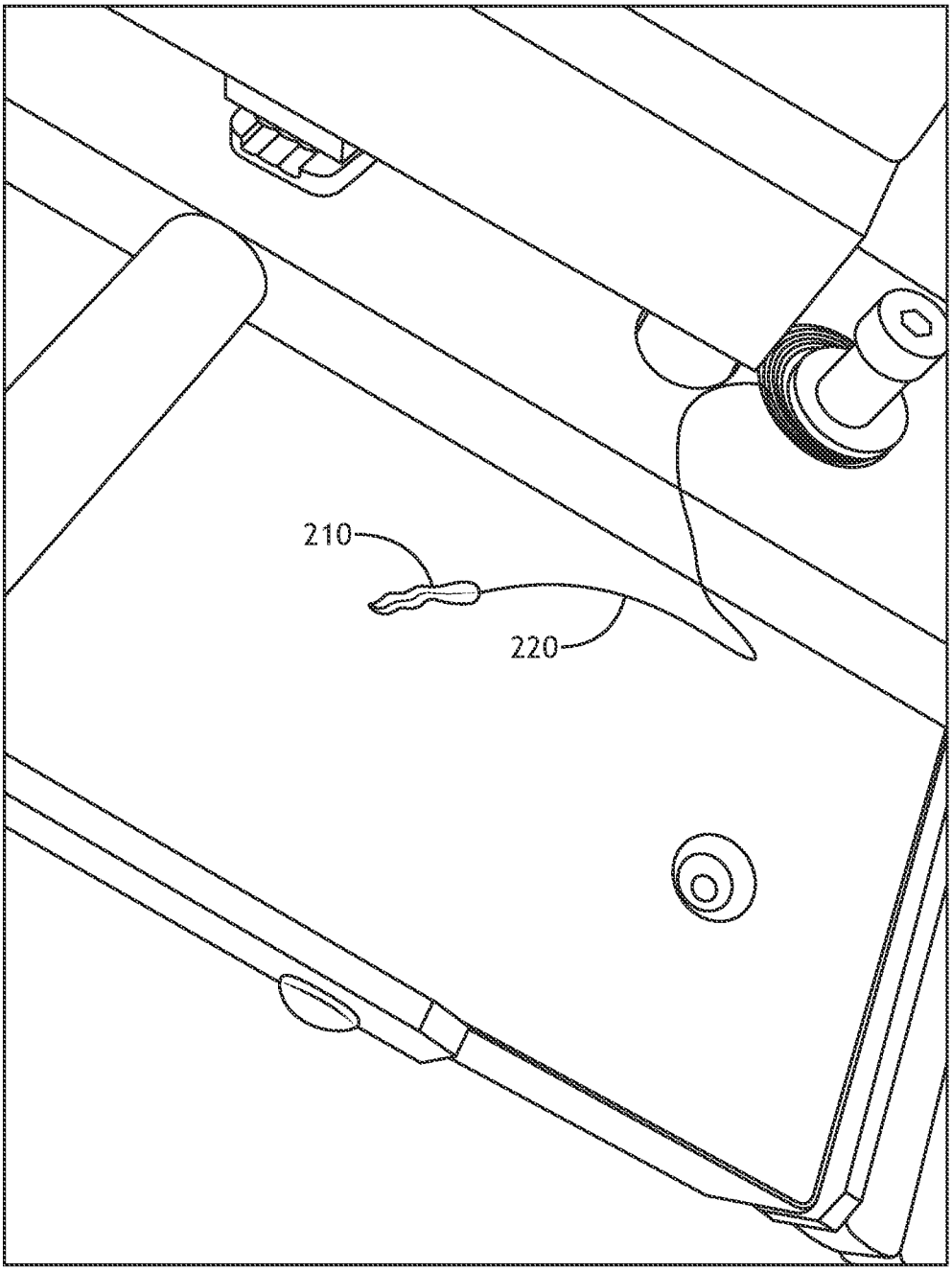
FIG. 2 is a diagram of a wire ferrule in accordance with an embodiment of this disclosure.

Referring to FIG. 2, a diagram of a wire ferrule 210 attached to the wire 220 of the hot wire assembly 130 is shown. The wire ferrule 210 may allow easier connection to a first mount 136A or second mount 136B of the hot wire assembly 130. It is contemplated that the wire ferrule 210 may provide a shoulder for the first mount 136A or second mount 136B in order to maintain the wire 220 of the hot wire assembly 130 taut. Advantageously, a wave pattern of the wire ferrule 210 may secure the wire 220 of the hot wire assembly 130 without needing to crimp the wire ferrule 210 as tight.

Figure 3A:
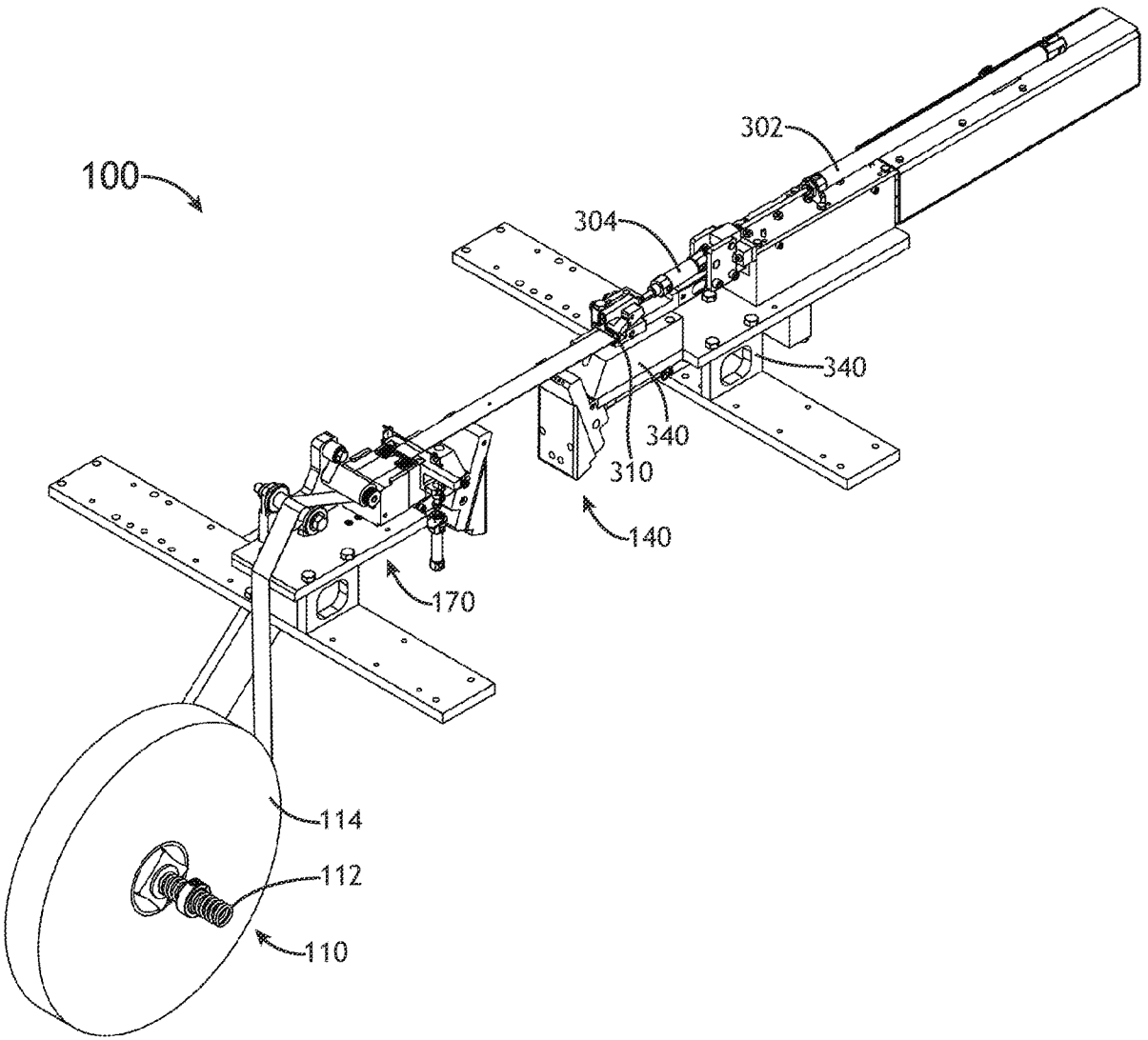
FIG. 3A is a diagram of the tape applicator apparatus including a tape cutter mechanism and a puller mechanism in accordance with an embodiment of this disclosure.

FIG. 3A is a diagram illustrating the tape applicator apparatus 100 in accordance with an embodiment of this disclosure.

The tape applicator apparatus 100 may include the tape cutter mechanism 170 and a puller mechanism 140.

The product tension mechanism 110 may maintain the tape 10 taut within the tape applicator apparatus 100 which allows the puller mechanism 140 to access a desired amount of tape 10. For example, the product tension mechanism 110 may include a spring 112 (e.g., torsion spring) proximate to an axle supporting the roll 114, wherein the spring 112 is coupled to the roll 114 (e.g., indirectly coupled by being coupled to the axle), and configured to maintain tension on the roll 114 (e.g., tension on the axle).

The puller mechanism 140 may be configured to move a cut portion (e.g., cut end) of the tape 10 after a cut has been completed by the hot wire assembly 130, by grabbing and pulling the tape 10.

The puller mechanism 140 may include a puller frame 340 and a grabber 310. The grabber 310 may be coupled to the puller frame 340 and may include a first grabber element 312A element and a second grabber element 312B. A grab actuator 304 be coupled to the grabber 310 and configured to activate a grab operation. The grab operation may be configured to grab (e.g., pinch, clamp) the tape 10 between the first grabber element 312A and the second grabber element 312B. A grab actuator 304 be coupled to a reach actuator 302.

The reach actuator 302 may be coupled to the puller frame 340. The reach actuator 302 may be configured to extend the grabber 310 towards the tape 10 in the cutting position of the tape cutter mechanism 170 and (after grabbing the tape 10) retract/pull the grabber 310 and the tape 10. For example, the reach actuator 302 may be configured to extend/retract a reach distance such as 6 inches or more, 12 inches or more, 24 inches or more, 36 inches or more, 48 inches or more, and/or 72 inches or more.

Figure 3B:
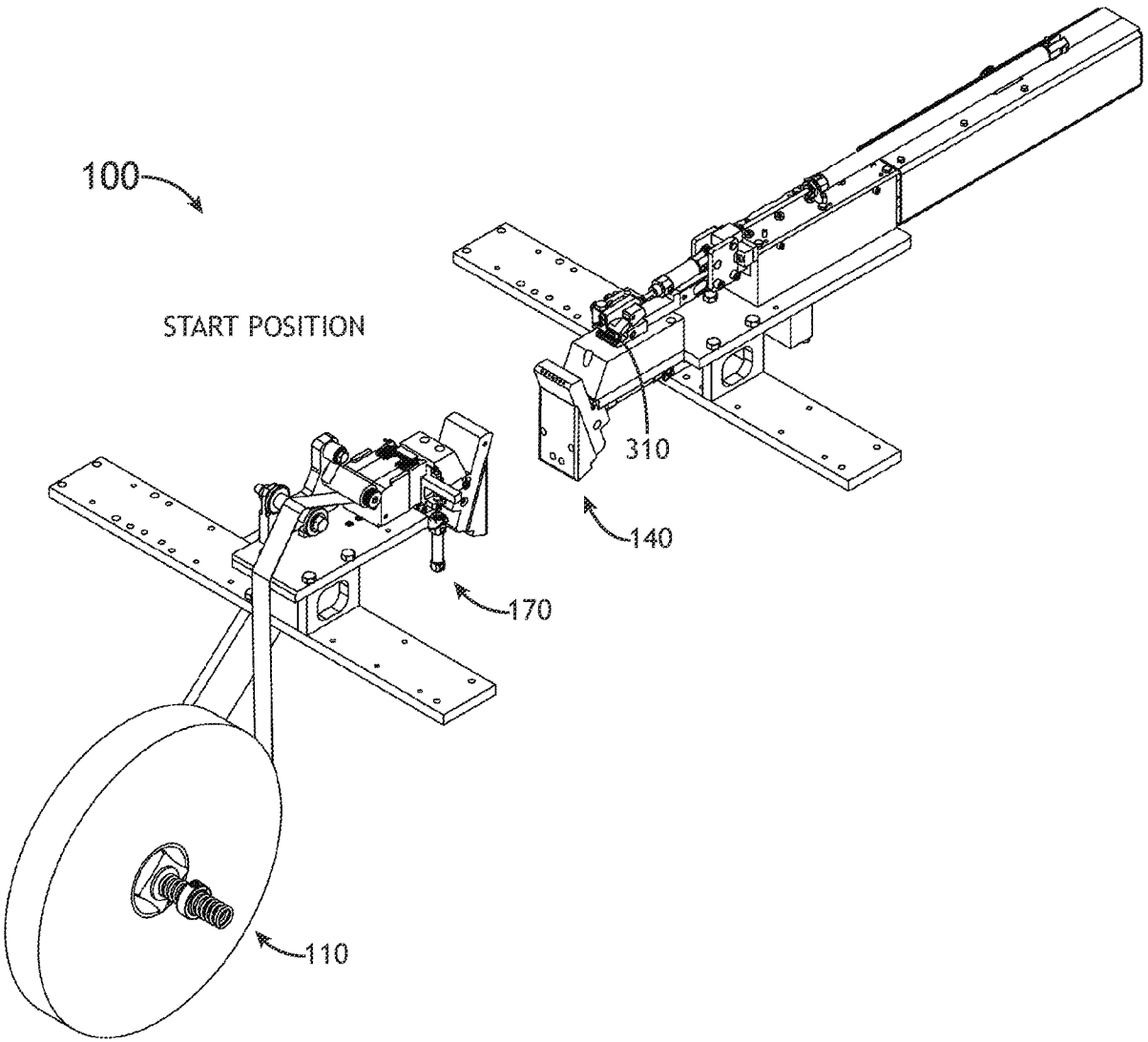
FIG. 3B is a diagram of the tape applicator apparatus with the puller mechanism in a start position, ready to extend and grab the tape, in accordance with an embodiment of this disclosure.

FIG. 3B is a diagram illustrating the tape applicator apparatus 100 with the puller mechanism 140 and grabber 310 in a start (nonextended) position, ready to extend the grabber 310 towards the tape 10, in accordance with an embodiment of this disclosure.

Figure 3C:
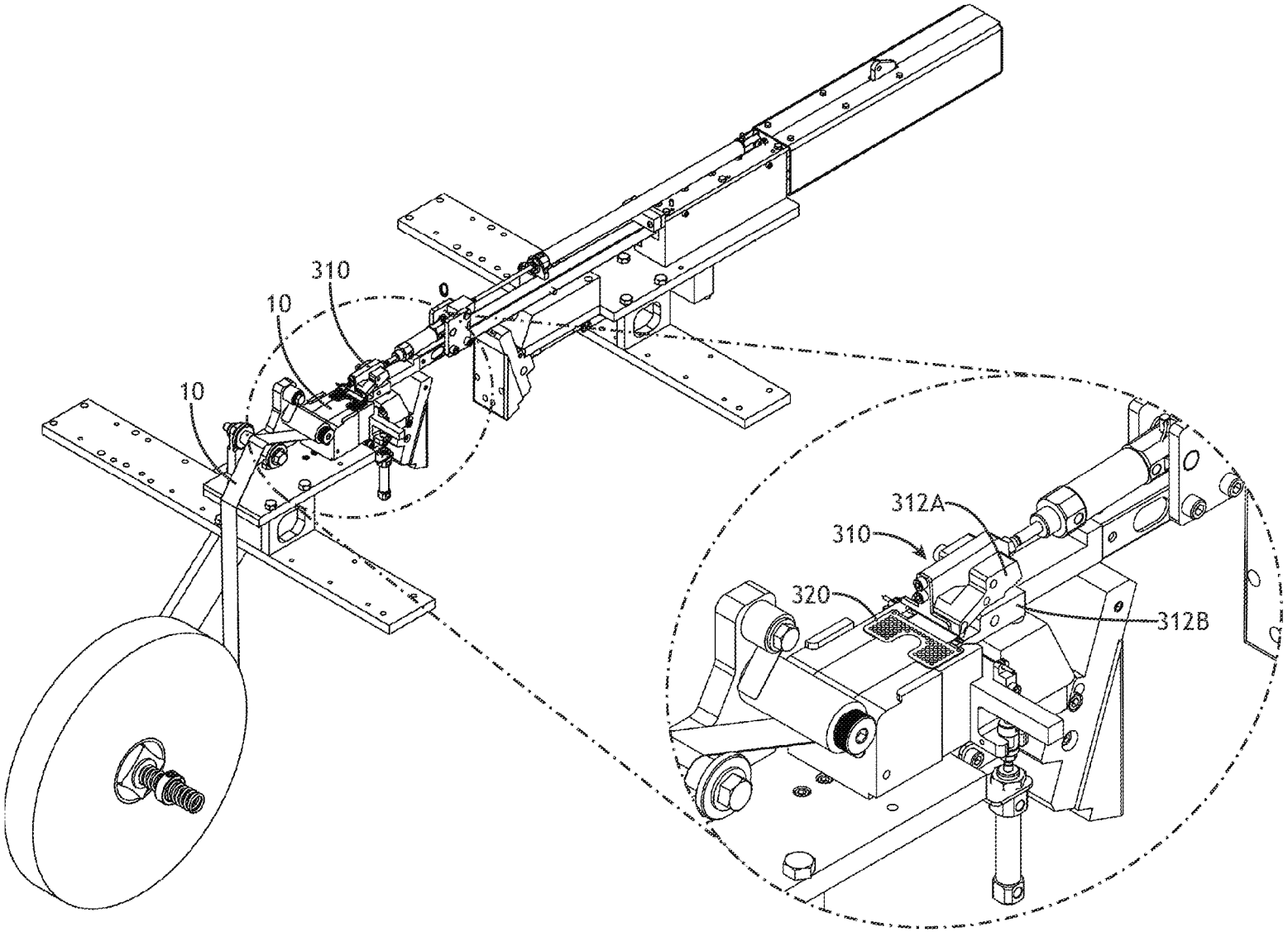
FIG. 3C is a diagram of the tape applicator apparatus with the puller mechanism in an extended position in accordance with an embodiment of this disclosure.

FIG. 3C is a diagram illustrating the tape applicator apparatus 100 with the grabber 310 of the puller mechanism 140 in an extended position in accordance with an embodiment of this disclosure.

Figure 3D:
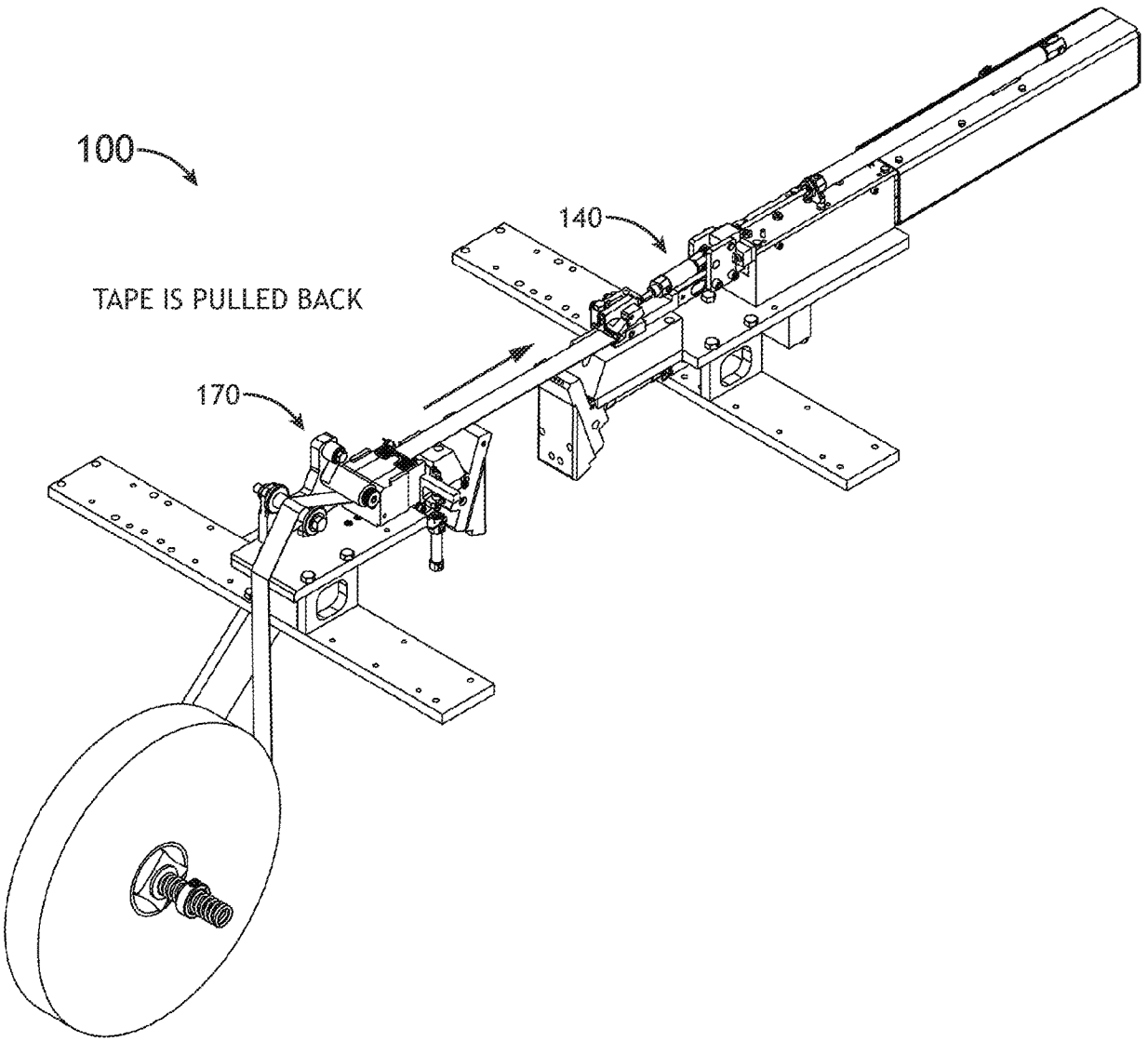
FIG. 3D is a diagram of the tape applicator apparatus with the puller mechanism in a retracted position, with the tape pulled, in accordance with an embodiment of this disclosure.

FIG. 3D is a diagram illustrating the tape applicator apparatus 100 with the grabber 310 of the puller mechanism 140 in a retracted position, with the tape 10 pulled, in accordance with an embodiment of this disclosure.

Figure 3E:
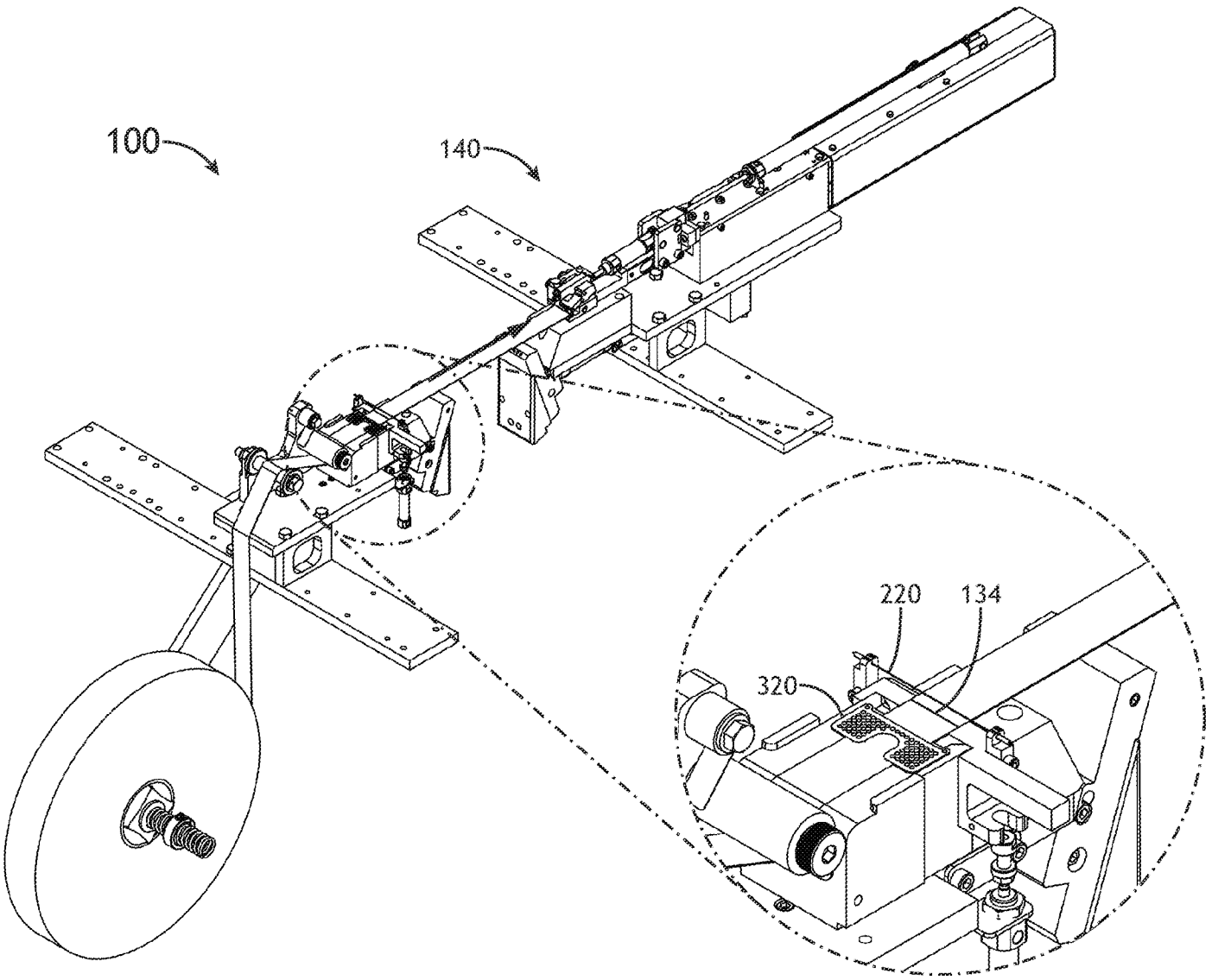
FIG. 3E is a diagram of the tape applicator apparatus with the moving assembly in an upper position, having just performed a cut of the tape, in accordance with an embodiment of this disclosure.

FIG. 3E is a diagram illustrating the tape applicator apparatus 100 with the moving assembly 120 in an upper position, having just performed a cut of the tape 10, in accordance with an embodiment of this disclosure. A tape edge 134 is created after the cut.

Figure 4:
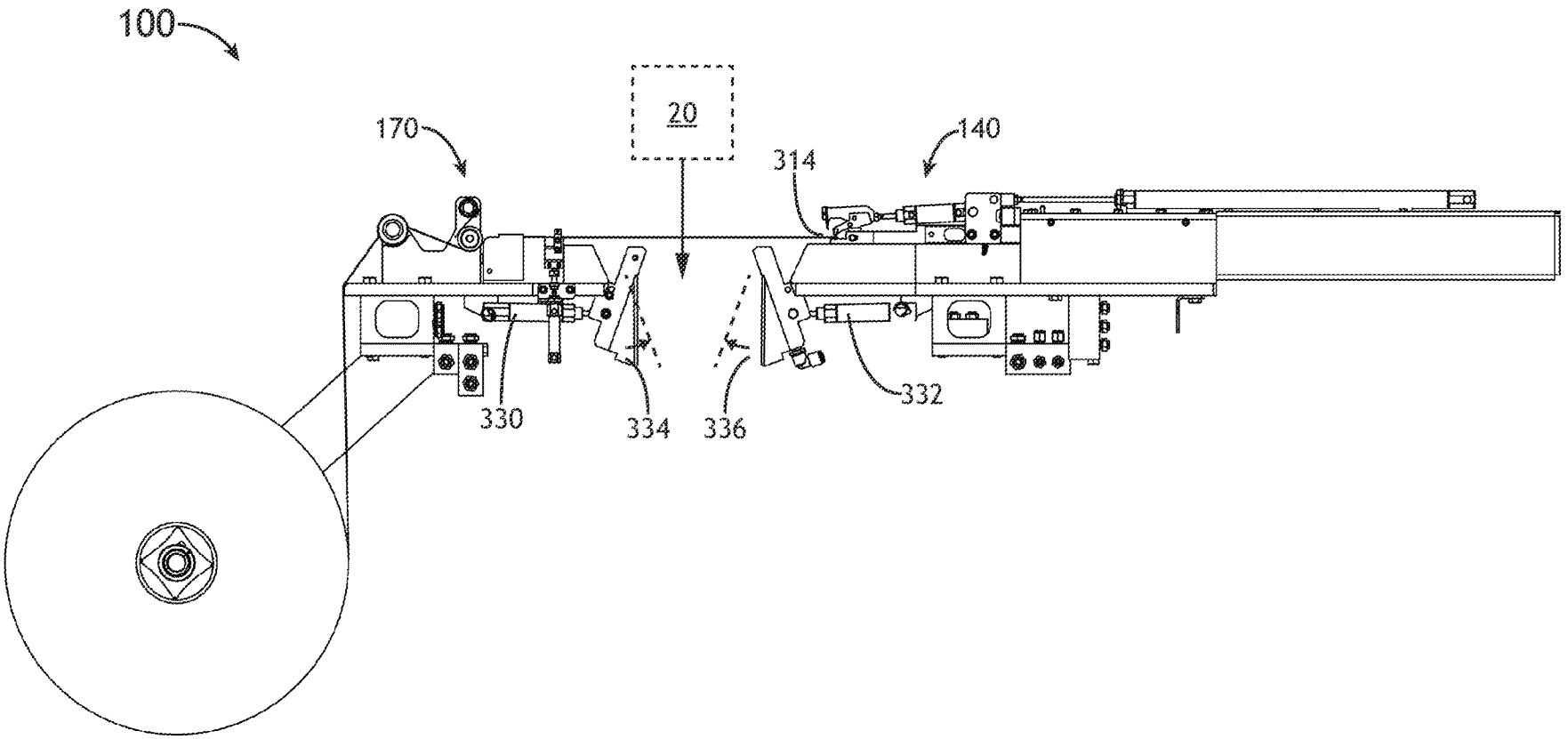
FIG. 4 is a side view diagram of the tape applicator apparatus and a package ready to land on the tape and have the tape wiped on using tape wipers in accordance with an embodiment of this disclosure.

FIG. 4 is a side view diagram illustrating the tape applicator apparatus 100 and a package 20 ready to contact the tape 10 and have the tape 10 wiped on the package 20 using tape wipers 334, 336 in accordance with an embodiment of this disclosure. For example, a grabbed end 314 of the tape 10 may be released (by releasing the grabber 310), and the tape 10 may be cut, thereby allowing the tape to rest on the tape applicator apparatus 100, and for the package 20 to fall (or be moved) onto the tape 10. A sticky (adhesive) side of the tape 10 may be configured to be facing up to contact the package 20.

Figure 5:
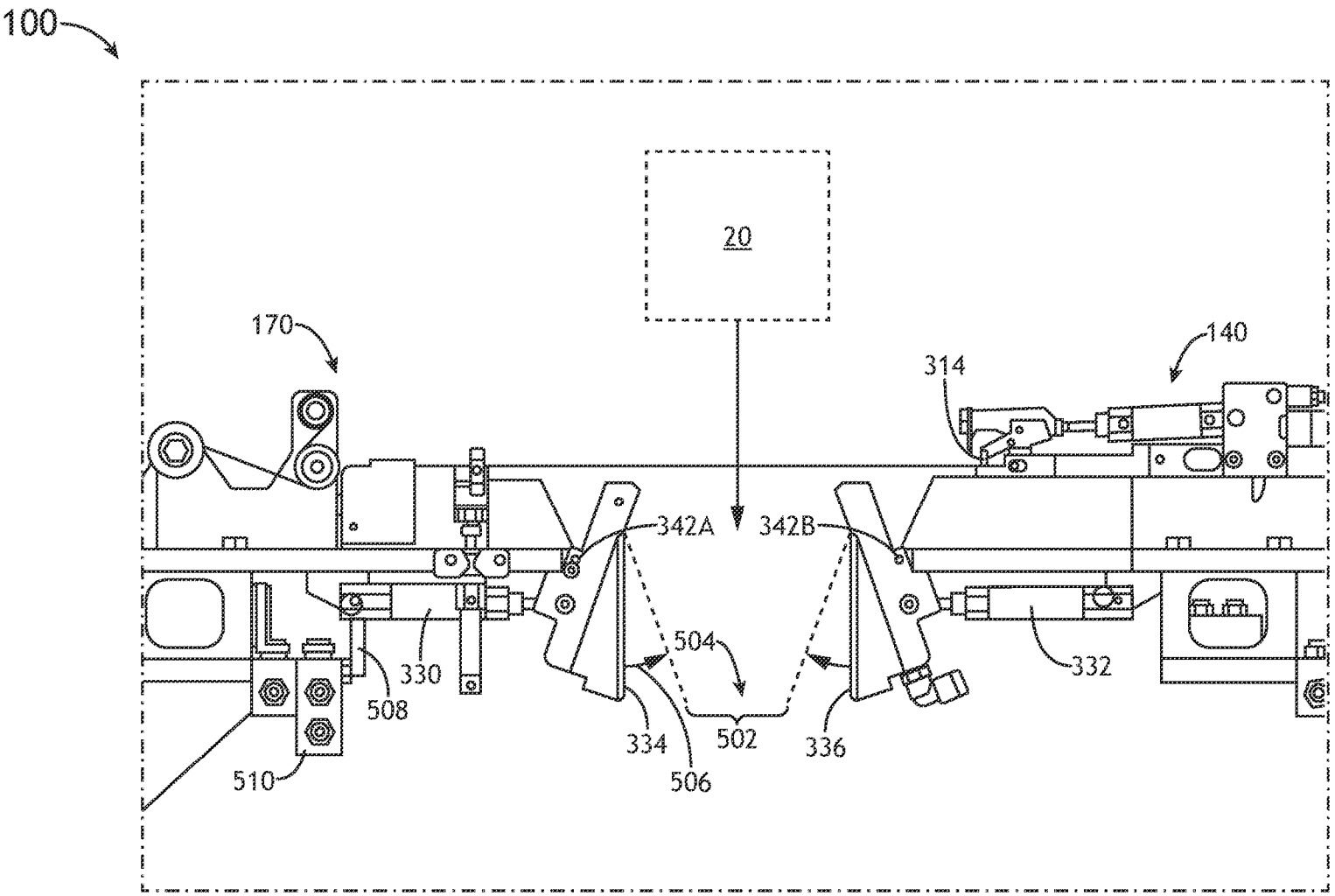
FIG. 5 is an enlarged side view diagram illustrating the tape applicator apparatus of FIG. 4 in accordance with an embodiment of this disclosure.

FIG. 5 is an enlarged side view diagram illustrating the tape applicator apparatus 100 of FIG. 4, in accordance with an embodiment of this disclosure.

A package 20 may be configured to be received between the tape cutter mechanism 170 and the puller mechanism 140. For example, the package 20 may be lowered, pushed into the tape 10 and/or the package 20 may land on the tape 10 and fall between the tape cutter mechanism 170 and the puller mechanism 140. In this way, for example, cardboard boxes and the like may be taped shut by dropping a seam of the package 20 onto the tape 10. For instance, the tape cutter mechanism 170 and the puller mechanism 140 may be located a package receiving distance 502 from each other. The package receiving distance 502 may define a package receiving void 504. The package receiving distance 502 may be any distance (e.g., horizontal distance). In some examples, the package receiving distance 502 (as fully extended, smallest) is 6 inches or more. In some examples, the package receiving distance 502 is 12 inches or more. In some examples, the package receiving distance 502 is 24 inches or more. In some examples, the package receiving distance 502 is 36 inches or more. In some examples, the package receiving distance 502 is 48 inches or more. In some examples, the package receiving distance 502 is 72 inches or more. In some examples, at its largest (both sides fully retracted), the package receiving distance 502 is 8 inches or more. In some examples, at its largest, the package receiving distance 502 is 16 inches or more. In some examples, a range of sizes (from retracted to extended) of the package receiving distance 502 is 2 inches or more. In some examples, a range of sizes of the package receiving distance 502 is 4 inches or more. In some examples, a range of sizes of the package receiving distance 502 is 12 inches or more. The tape 10 may be configured to be wiped onto the package 20 as the package 20 moves (e.g., while falling) using a first tape wiper 334 of the tape cutter mechanism 140 and using a second tape wiper 336 of the puller mechanism 140.

The tape wipers 334, 336 may include wipe surfaces 334, 336, which may be substantially smooth/flat along the depth direction for applying even pressure to the tape 10. For example, the wipe surfaces 334, 336 may be at least a tape width in depth and at least two tape widths in height. For instance, the tape width may be at least 1.5 inches. For instance, the tape width may be at least 2 inches. For instance, the tape width may be at least 2.5 inches. In some examples, a wipe surface 334 is 2 inches deep or more by 4 inches high or more.

The grabber 310 aligns (vertically and depth) with the tape 10, and the first tape wiper 334 aligns (vertically and depth) with the second tape wiper 336.

The tape wipers 334, 336 may be adjustable for different sized packages 20. The tape wipers 334, 336 may be configured to rotate a wiper angle 506 (e.g., non-zero wiper angle such as 3 degrees or more, 10 degrees or more, 20 degrees or more) as measured inwards from vertical (normal to the extended tape 10). For example, the first tape wiper 334 may be coupled to the first frame 172 and a first wiper actuator 330 (e.g., a hydraulic or pneumatic cylinder actuator). The first wiper actuator 330 may be configured to rotate the first tape wiper 334 around a first wiper axle 342A and towards the second tape wiper 336. The second tape wiper 336 may be coupled to the puller frame 340 and a second wiper actuator 332. The second wiper actuator 332 may be configured to rotate the second tape wiper 336 around a second wiper axle 342B and towards the first tape wiper 334. The wiper axles 342A, 342B, and rollers 150A, 150B, may be substantially aligned (e.g., parallel), such as being with 10 degrees of alignment.

The tape applicator apparatus 100 may include any number of elements for selectively controlling (e.g., actuating) the actuators, such as elements in the art for actuating hydraulic actuators, pneumatic actuators, and/or the like. For example, the tape applicator apparatus 100 may include one or more valve blocks 510 (e.g., hydraulic valve block, or pneumatic valve block) configured for one or more functions. For instance, the valve block 510 may be configured to selectively actuate the grab actuator 304, the reach actuator 302, the moving assembly actuator 122, the first wiper actuator 330, and the second wiper actuator 332 via lines 508 (e.g., hoses carrying pressurized liquid or air).

For instance, each valve block 510 may be electronically controlled via, and/or include, a controller. The controller may, but is not necessarily required to, include a memory and a processor. For instance, the controller may be a switch panel for manually and/or autonomously (e.g., automatically) operating the actuators to grab, pull/retract, release, and cut the tape 10, repeatedly and continuously to securely lock in place the openings of packages 20 or the like. The controller may be electronically coupled to the valve block 510 via a wire to selectively power (e.g., open and close) the valves of the valve block 510 that correspond to the desired actuation to be performed.

Although inventive concepts have been described with reference to the embodiments illustrated in the attached drawing figures, equivalents may be employed and substitutions made herein without departing from the scope of the claims. Components illustrated and described herein are merely examples of a system/device and components that may be used to implement embodiments of the inventive concepts and may be replaced with other devices and components without departing from the scope of the claims. Furthermore, any dimensions, degrees, and/or numerical ranges provided herein are to be understood as non-limiting examples unless otherwise specified in the claims.

What is claimed is:

1. A tape applicator apparatus comprising:

a tape cutter mechanism comprising:

a first frame;

a product tension mechanism coupled to the first frame and configured to support a tape roll including tape;

a device to position the tape in proximity with a hot wire assembly;

the hot wire assembly coupled to the first frame, wherein the hot wire assembly comprises:

a first mount, a second mount, and a wire between the first amount and the second mount, an electrical power source coupled to the wire and configured to heat the wire; and a moving assembly configured to raise and lower the hot wire assembly, wherein the first frame is configured to route the tape to a cutting position, wherein the wire is configured to perform a cut of the tape in the cutting position via the moving assembly; and a puller mechanism comprising:

a puller frame;

a grabber coupled to the puller frame and comprising: a first grabber element and a second grabber element;

a grab actuator coupled to the grabber and configured to activate a grab operation of the grabber, wherein the grab operation is configured to grab the tape between the first grabber element and the second grabber element; and a reach actuator coupled to the puller frame and the grabber, wherein the reach actuator is configured to extend the grabber towards the tape in the cutting position of the tape cutter mechanism and retract the grabber and the tape, wherein a package is configured to be received between the tape cutter mechanism and the puller mechanism such that the package lands on the tape and falls between the tape cutter mechanism and the puller mechanism.

2. The tape applicator apparatus of claim 1, wherein the electrical power source supplies a 2-9 volt voltage input to the wire.

3. The tape applicator apparatus of claim 2, wherein the voltage input to the wire is pulsed.

4. The tape applicator apparatus of claim 1, wherein the moving assembly comprises at least one of an air cylinder, or a hydraulic cylinder.

5. The tape applicator apparatus of claim 1, wherein the device to position the tape in proximity with the hot wire assembly comprises a vacuum block.

6. The tape applicator apparatus of claim 1, wherein the device to position the tape in proximity with the hot wire assembly comprises an air block that supplies air toward the tape.

7. The tape applicator apparatus of claim 1, wherein the tape is configured to be wiped onto the package as the package falls below the tape applicator apparatus via a first tape wiper of the tape cutter mechanism and via a second tape wiper of the puller mechanism.

8. The tape applicator apparatus of claim 7, wherein the first tape wiper is coupled to the first frame and a first wiper actuator is configured to rotate the first tape wiper towards the second tape wiper.

9. The tape applicator apparatus of claim 7, wherein the second tape wiper is coupled to the puller frame and a second wiper actuator is configured to rotate the second tape wiper towards the first tape wiper.

10. The tape applicator apparatus of claim 7, wherein the tape cutter mechanism is located a package receiving distance from the puller mechanism.

11. The tape applicator apparatus of claim 10, wherein the package receiving distance is 6 inches or more.

12. The tape applicator apparatus of claim 10, wherein the package receiving distance is 24 inches or more.

13. The tape applicator apparatus of claim 10, wherein a range of sizes of the package receiving distance is 4 inches or more.

14. The tape applicator apparatus of claim 13, wherein the first tape wiper is configured to rotate a non-zero wiper angle of the first tape wiper and the second tape wiper is configured to rotate a non-zero wiper angle of the second tape wiper, wherein both the non-zero wiper angle of the first tape wiper and the non-zero wiper angle of the second tape wiper are measured inwards from vertical, normal from the tape.

15. The tape applicator apparatus of claim 14, wherein both the non-zero wiper angle of the first tape wiper and the non-zero wiper angle of the second tape wiper are 3 degrees or more.

16. The tape applicator apparatus of claim 14, wherein both the non-zero wiper angle of the first tape wiper and the non-zero wiper angle of the second tape wiper are 10 degrees or more.

17. The tape applicator apparatus of claim 14, wherein both the non-zero wiper angle of the first tape wiper and the non-zero wiper angle of the second tape wiper are 20 degrees or more.

18. The tape applicator apparatus of claim 1, wherein the reach actuator is configured for a reach distance of 12 inches or more.

19. The tape applicator apparatus of claim 1, wherein the reach actuator is configured for a reach distance of 24 inches or more.

* * * * *